US011408584B1

(12) United States Patent
Chan et al.

(10) Patent No.: US 11,408,584 B1
(45) Date of Patent: Aug. 9, 2022

(54) ILLUMINATING DEVICE WITH SPHERICAL MODULATOR

(71) Applicant: AIPhotonics Limited, Hong Kong (HK)

(72) Inventors: Ho-Yin Chan, Hong Kong (HK); Boliang Jia, Hong Kong (HK); Qingjiu Chen, Hong Kong (HK); Wen J Li, Hong Kong (HK)

(73) Assignee: AIPhotonics Limited, Hong Kong (HK)

( * ) Notice: Subject to any disclaimer, the term of this patent is extended or adjusted under 35 U.S.C. 154(b) by 0 days.

(21) Appl. No.: 17/361,344

(22) Filed: Jun. 29, 2021

(51) Int. Cl.
*F21V 3/06* (2018.01)
*F21V 3/02* (2006.01)
*F21Y 107/20* (2016.01)

(52) U.S. Cl.
CPC ..... *F21V 3/061* (2018.02); *F21V 3/02* (2013.01); *F21Y 2107/20* (2016.08)

(58) Field of Classification Search
CPC ..... F21V 3/061; F21V 3/02; F21Y 2107/20
See application file for complete search history.

(56) References Cited

U.S. PATENT DOCUMENTS 7,248,413 B2 7/2007 Quake et al.
2003/0016452 A1 1/2003 Sayag

FOREIGN PATENT DOCUMENTS

DE 102005003594 A1 * 7/2006 ..... B29D 11/00

* cited by examiner

*Primary Examiner* — Alan B Cariaso
(74) *Attorney, Agent, or Firm* — Idea Intellectual Limited; Margaret A. Burke; Sam T. Yip

(57) ABSTRACT

An illuminating device comprises a light source, a lens holder, and a spherical modulator. The lens holder has a concave part and a blocking part surrounding the concave part. The concave part has an aperture on the bottom. The spherical modulator contains materials having refractive indexes ranging from 1.3 to 2.7. The lens holder is located between the light source and the spherical modulator. The spherical modulator is disposed on the concave part of the lens holder and covers the aperture. The light source provides light towards the aperture. The light source and the aperture are aligned to an optical axis of the spherical modulator.

11 Claims, 11 Drawing Sheets

100B

100F

ILLUMINATING DEVICE WITH SPHERICAL MODULATOR

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention generally relates to optical devices, and more particularly, to illuminating devices with spherical modulator.

BACKGROUND OF THE INVENTION

The photon output of the LED is due to an electron given up energy as it makes a transition from the conduction band to the valence band. The LED photon emission is spontaneous in that each band-to-band transition is an independent event. The spontaneous emission process yields a spectral output of the LED with a fairly wide bandwidth. The structure and operating condition of the LED, however, can be modified so that the device operates in a new mode, producing a coherent spectral output with a bandwidth of wavelengths less than 0.1 nm. This is a laser diode, where laser stands for Light Amplification by Stimulated Emission of Radiation. Laser diodes can directly convert electrical energy into light.

The vertical-cavity surface-emitting laser, or VCSEL, is a type of semiconductor laser diode with laser beam emission perpendicular from the top surface. VCSELs are used in a vast number of laser-incorporated products, including, computer mice, fiber optic communications, laser printers, facial ID scanner, smart-glasses, etc.

Dimensions of VCSELs are typically less than 200 μm. The dimensions of the accompanying optical lens, which control the convergence of light emitting from the laser diodes are similarly small. At these small dimensions, the assembly and adjustment of the optical lens and the VCSELs are of great challenges, and better yield in the production of VCSEL products is left wanted in the field.

SUMMARY OF THE INVENTION

The present invention seeks to provide an illuminating device configured to produce converged to parallel light beams from a solid-state light source.

According to one aspect of the present invention, an illuminating device is provided for producing a parallel or converged light. An illuminating device comprises a light source, a lens holder, and a spherical modulator. The lens holder has a concave part and a blocking part surrounding the concave part. The concave part has an aperture on the bottom. The spherical modulator contains one or more materials having refractive indexes ranging from 1.3 to 2.65. The lens holder is located between the light source and the spherical modulator. The spherical modulator is disposed on the concave part of the lens holder and covers the aperture. The light source provides light beams in a direction towards the aperture. The light source and the aperture are aligned to an optical axis of the spherical modulator.

In an embodiment of the present invention, the distance between the center of the spherical modulator and the light source is no more than a focal length of the spherical modulator. The blocking part forms a plate-like rim around the spherical modulator, and the lens holder is opaque or reflective, and a ratio of a diameter of the spherical modulator to a diameter of the lens holder ranges from 1 to 100. The shape of the rim is polygon or circle. The concave part forms a plate-like lip around the aperture, and the curvature of the lip and an outer surface of the spherical modulator are the same. The lens holder is made of one or more materials comprising semiconducting materials and/or polymer-based materials.

In one embodiment, the spherical modulator has a sphere, and the sphere has a diameter ranging from 5 μm to 500 um.

In another embodiment, the spherical modulator has a plurality of first micro spheres, and a diameter of every first micro sphere is at least 10 times smaller than a wavelength of the light from the light source.

In yet another embodiment of the present invention, the spherical modulator has a plurality of second micro spheres, and a ratio of a diameter of every second micro sphere to the diameter of every first micro sphere ranges from 0.1 to 0.9.

In one embodiment, a refractive index of a material of the first micro sphere and a refractive index of a material of the second micro sphere are different.

In another embodiment, a material of the first micro sphere can be glass or polymers.

BRIEF DESCRIPTION OF THE DRAWINGS

Embodiments of the invention are described in more details hereinafter with reference to the drawings, in which.

DETAILED DESCRIPTION

The embodiments of the present invention provide an illuminating device having a spherical modulator and a lens holder, and the illuminating device is configured to produce converged or parallel light.

Figure 1:
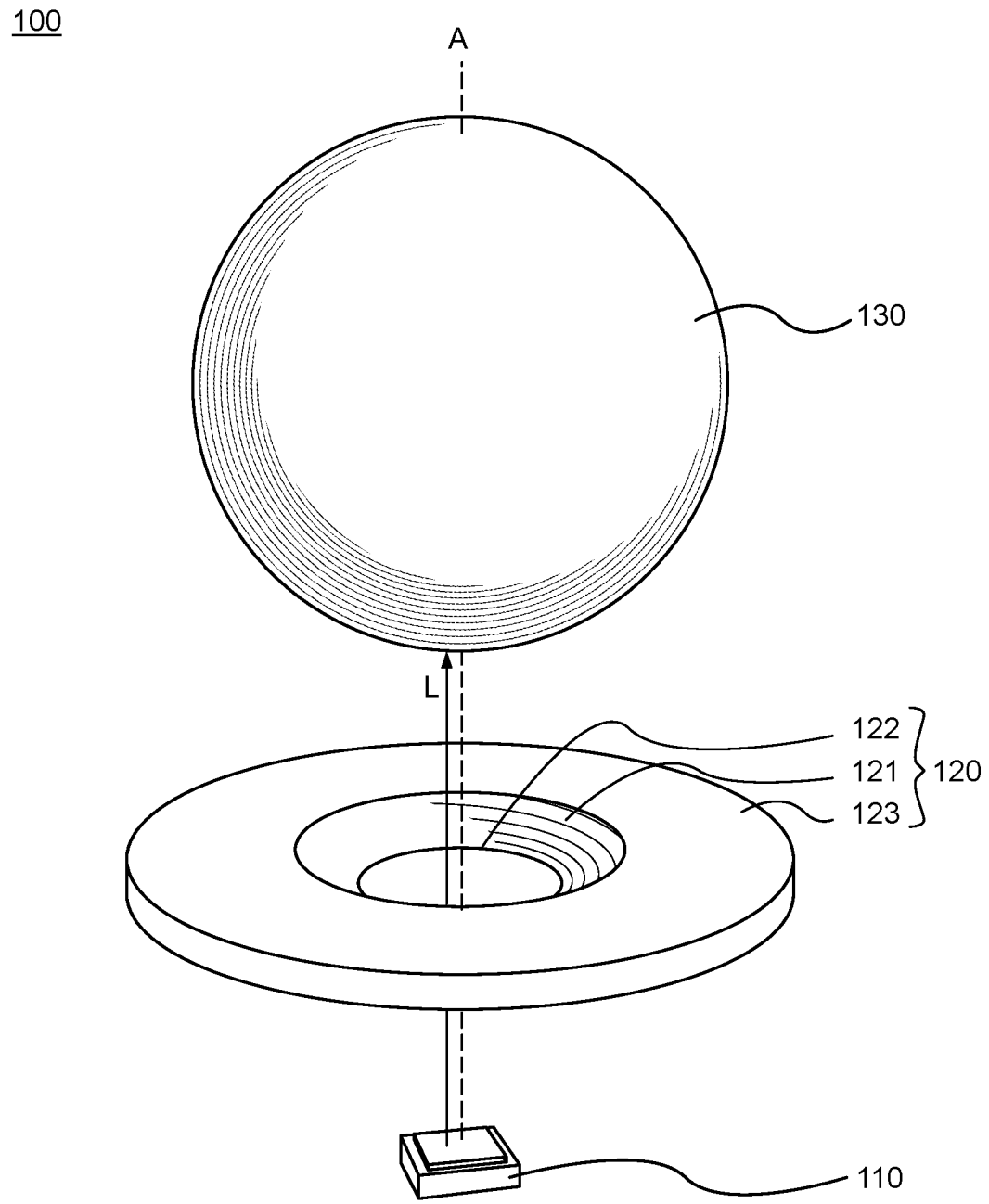
FIG. 1 is a perspective view of an illuminating device of an embodiment of the present invention.

Referring to FIG. 1, the illuminating device 100 of the embodiment includes a light source 110, a lens holder 120, and a spherical modulator 130. The lens holder 120 is fixed in between the light source 110 and the spherical modulator 130.

In various embodiments of the present invention, the spherical modulator 130 contains one or more materials having refractive indexes ranging from 1.3 to 2.65. The spherical modulator 130 is a modulator in the form of a sphere, and the materials occupy more than 70% of the space in the sphere, and the materials cover more than 90% of the surface of the sphere.

For example, the materials of the spherical modulator 130 can be glass and/or polymers. In various embodiments, the materials may include fused silica, PMMA, polycarbonate, sapphire, diamond, or moissanite, or any light transmissive material having refractive index in the range from 1.3 to 2.65. A skilled person in art will appreciate that other materials can be adopted without undue experimentation and deviation from the spirit of the present invention.

The lens holder 120 is fixed in between the light source 110 and the spherical modulator 130. The lens holder 120 is located above the light source 110, and the spherical modulator 130 is disposed on the lens holder 120.

The lens holder 120 has a concave part 121 and a blocking part 123. The blocking part 123 surrounds the concave part 121, and the concave part 121 has an aperture 122 on the bottom. On the lens holder 120, the concave part 121 is hollowed inward, and the aperture 122 is formed in the middle of the concave part 121.

The spherical modulator 130 contains one or more materials having refractive indexes ranging from 1.3 to 2.65, and the spherical modulator 130 is disposed on the concave part 121 of the lens holder 120. The spherical modulator 130 covers the aperture 122, and the light source 110 provide light L in direction towards the aperture 122. The spherical modulator 130 receives the light L from the light source 110 through the aperture 122 of the lens holder 120.

The light source 110 and the aperture 122 are aligned to an optical axis A. In various embodiments, the lens holder 120 reveals the top surface (i.e., the light emitting surface) of the light source 110, and covers the surrounding area of the light source 110.

Figure 2:
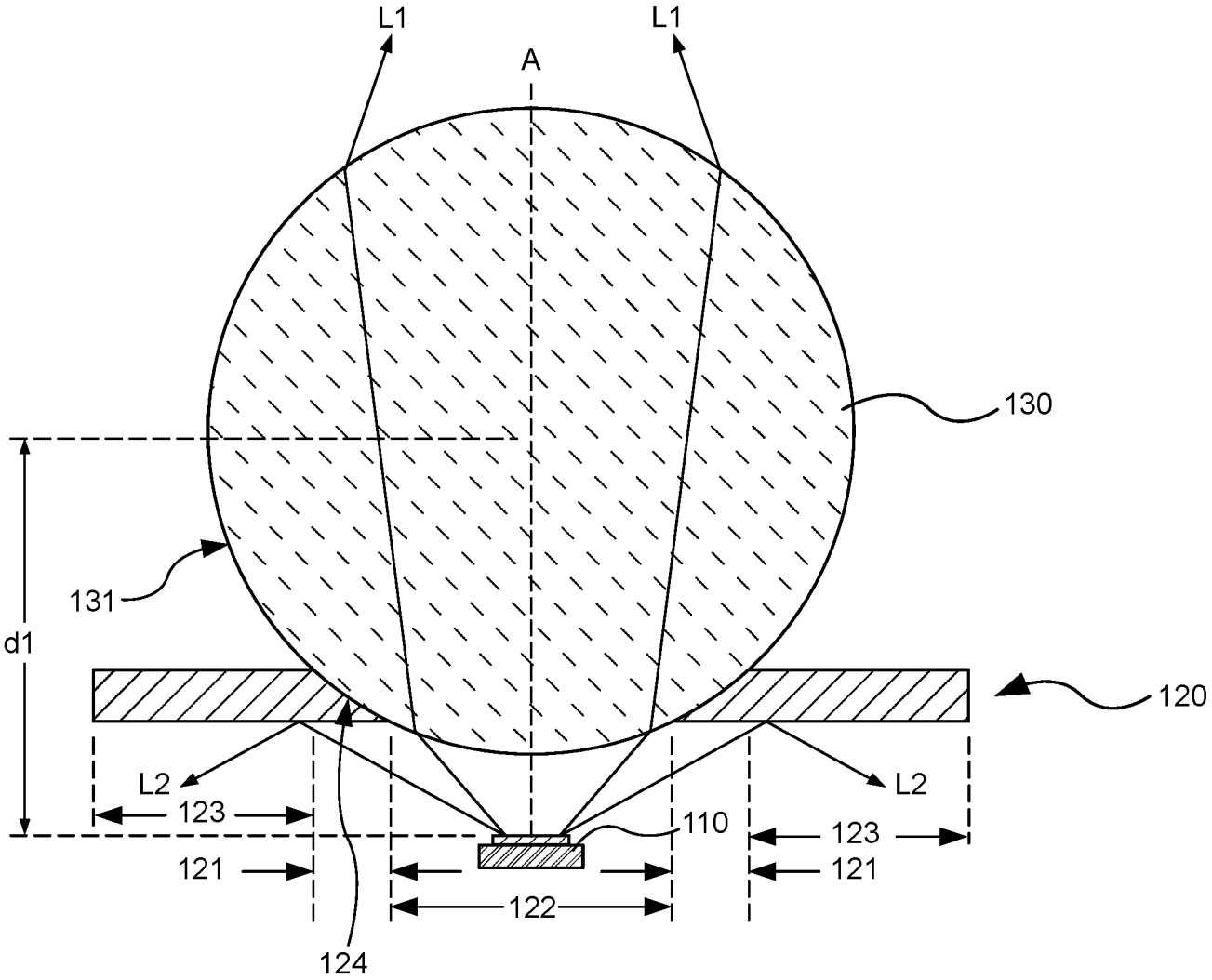
FIG. 2 is a side-sectional view of the illuminating device.

Referring to FIG. 2. In this embodiment, the light incident area of the outer surface of the spherical modulator 130 can be defined by the aperture 122 of the lens holder 120, and the concave part 121 is shaped to prevent the spherical modulator 130 from moving, and the blocking part 123 of the lens holder 120 reflects the light emitted from the light source 110 with large optical angle (i.e., the angle between the emitting direction and the normal vector of the light emitting surface). Therefore, the lens holder 120 controls the location of the spherical modulator 130 in respect to the light source 110, and the illuminating device 100 produces converged light with high efficiency.

More specifically, the distance d1 between the center of the spherical modulator 130 and the light source 110 is no more than a focal length of the spherical modulator 130. In this embodiment, d1 is less than the focal length of the spherical modulator 130, and, therefore, the illuminating device 100 can provide converged light L1. Also, some of the light L2 with large optical angle is reflected by the lens holder 120. In other words, the spherical modulator 130 can converge the light L1, and the lens holder 120 can further control the incident light of the spherical modulator 130, so as to provide a well-converged light L1.

Figure 3:
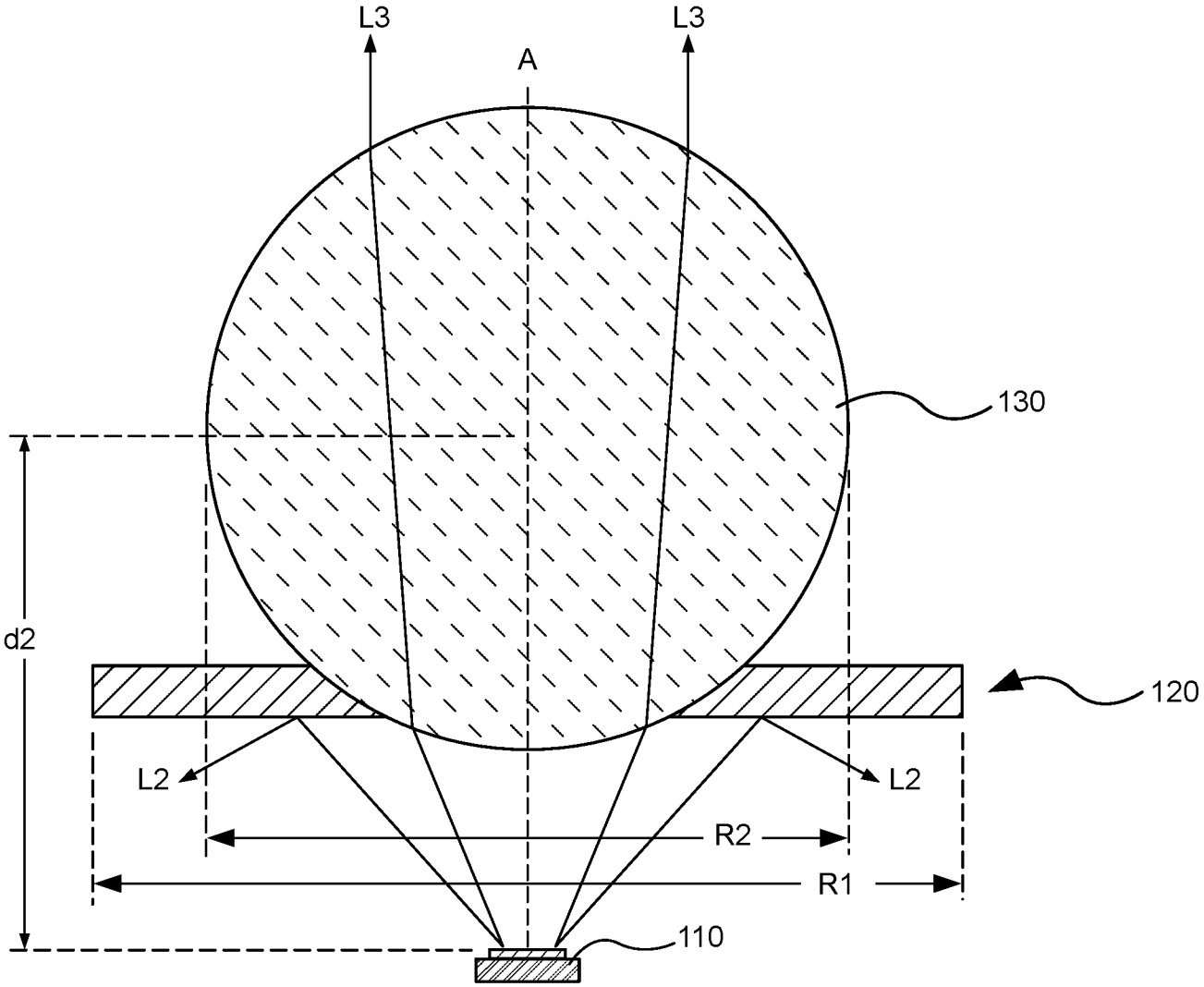
FIG. 3 is another side-sectional view of the illuminating device.

FIG. 3 is another side-sectional view of the illuminating device 100. The distance d2 between the center of the spherical modulator 130 and the light source 110 is equal to the focal length of the spherical modulator 130, and, therefore, the illuminating device 100 can provide parallel light L3 with the spherical modulator 130 and the light source 110.

In this embodiment, the lens holder 120 is reflective, and some of L2 with large optical angle will be reflected by the lens holder 120. In various embodiments, the lens holder 120 is opaque, and L2 is blocked.

More specifically, the blocking part 123 forms a plate-like rim around the spherical modulator 130, and a ratio of a diameter R2 of the spherical modulator 130 to a diameter R1 of the lens holder 120 ranges from 1 to 100. The lens holder 120 is wide enough to block out unwanted light L2.

Figure 4:
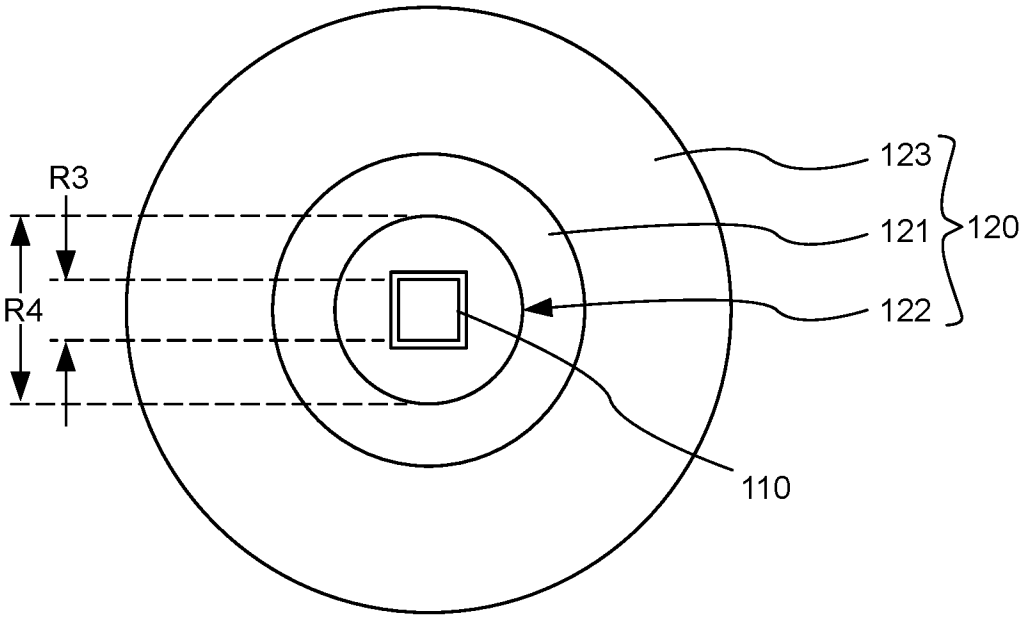
FIG. 4 is a top view of a lens holder and a light source in an embodiment of the present invention.

FIG. 4 is a top view of the lens holder 120 and the light source 110. The lens holder 120 provides sufficient opening for the light source 110 as well. The aperture 122 of the concave part 121 reveals the light source 110. More specifically, the light source 110 is, for example, a VCSEL, and the aperture 122 is adapted to reveal the light emitting surface of the light source 110. In this embodiment, the width R3 of the light emitting surface of the light source 110 is smaller than the diameter R4 of the aperture 122 of the lens holder 120. More specifically, the ratio of R4 to R3 is larger than 1, and, therefore, the aperture 122 may allow most of the wanted light from the light source 110.

In this embodiment, the shape of the rim of the lens holder 120 is circle.

Figure 5:
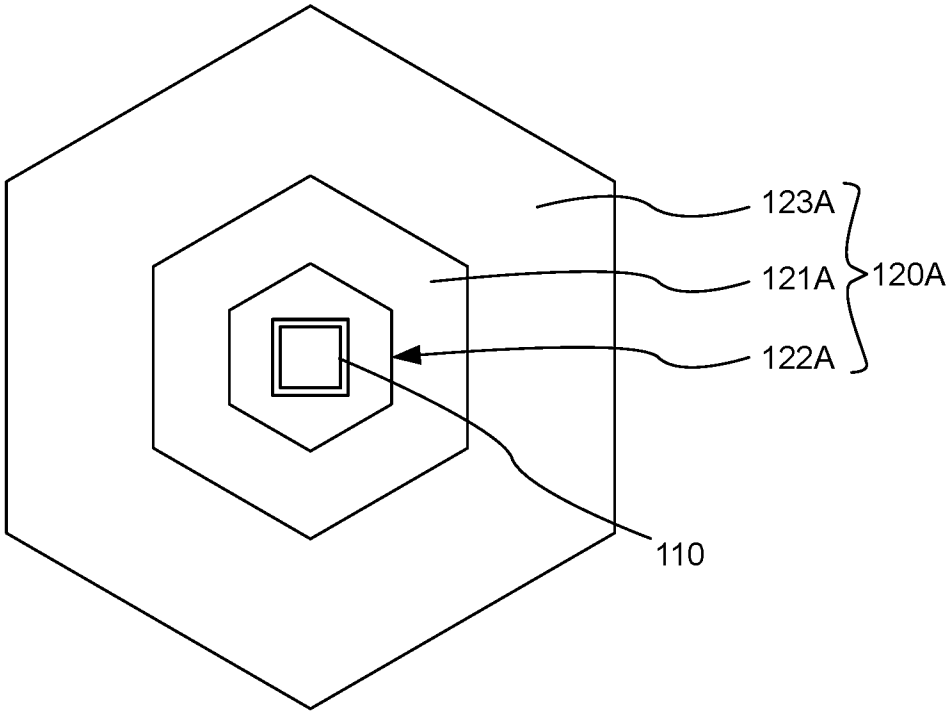
FIG. 5 is another top view of the lens holder and the light source.

Referring to FIG. 5. The shape of the rim of the lens holder 120A is a polygon. For example, the rim of the lens holder 120A is a hexagon, and the boarder of the concave part 121A and the aperture 122A are hexagon as well, and the aperture 122A can reveals the light source 110 properly. In other embodiments, the shape of the rim of the lens holder 120 may be any kind of polygon including square, triangle, pentagon, and the lens holder 120 can be properly fixed on other components.

Moreover, referring to FIGS. 2 and 3, the concave part 121 of the lens holder 120 forms a plate-like lip around the aperture 122, and the curvature of the lip (i.e., upper surface 124 of the concave part 121) and curvature of the outer surface 131 of the spherical modulator 130 are the same. Therefore, the aperture 122 is able to accommodate the bottom part of the spherical modulator 130.

In this embodiment, the materials of the lens holder 120 may include semiconducting materials and/or polymer-based materials. For example, the materials may include silicon, polysilicon, PMMA, or SU-8.

The spherical modulator 130 of this embodiment has a sphere, and diameter R2 of the sphere ranges from 5 um to 500 um. As described above, the spherical modulator 130 can converged the light from the light source 110, and the dimension is also corresponded to the light source 110.

For example, the material of the sphere in the spherical modulator 130 can be glass or polymer, or any other light transmissive material having refractive index ranges from 1.3 to 2.65.

Figure 6:
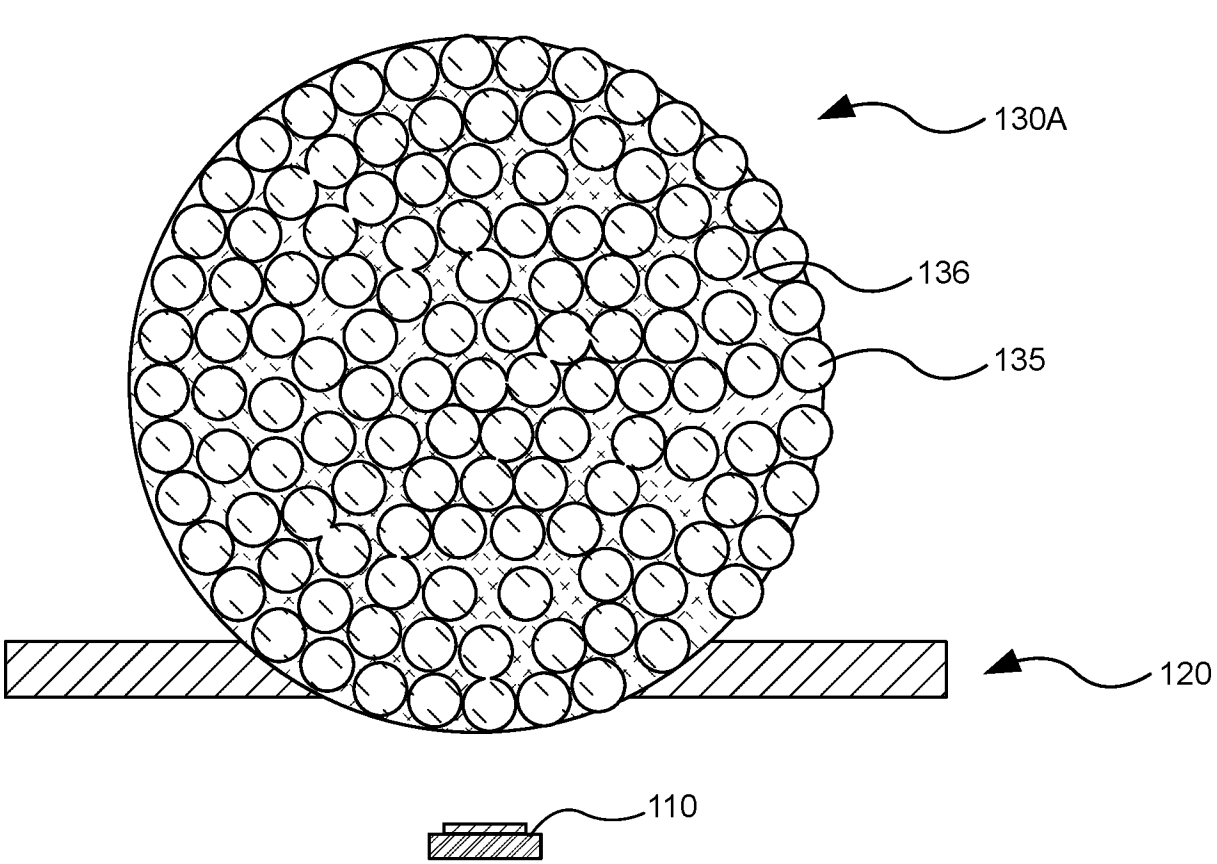
FIG. 6 is a side sectional view of an illuminating device of another embodiment of the present invention.

Referring to FIG. 6. In this embodiment, the illuminating device 100A has a light source 110, a lens holder 120, and a spherical modulator 130A. The spherical modulator 130A on the lens holder 120 has a plurality of micro spheres 135, and a diameter of every micro sphere 135 is at least 10 times smaller than a wavelength of the light from the light source 110.

For example, the wavelength of the light from the light source 110 may be 700 nm, and the dimeter of the micro sphere 135 may be 70 nm.

More specifically, the spherical modulator 130A has an adhesive 136, and the adhesive 136 hold the micro spheres 135 in the spherical modulator 130A. For example, the adhesive 136 may include epoxy, and the micro spheres 135 are all connected by the adhesive 136, and material of the micro spheres 135 may include glass or polymer.

In this embodiment, the micro spheres 135 are randomly distributed in the spherical modulator 130A, and the adhesive 136 occupies the rest of the area. Furthermore, a material of the adhesive 136 has a refractive index that is different form the refractive index of the material of the micro spheres 135. For example, the refractive index of the material of the adhesive 136 is close to 1, and, therefore, the micro spheres 135 in the spherical modulator 130A can provide proper light refraction.

Figure 7:
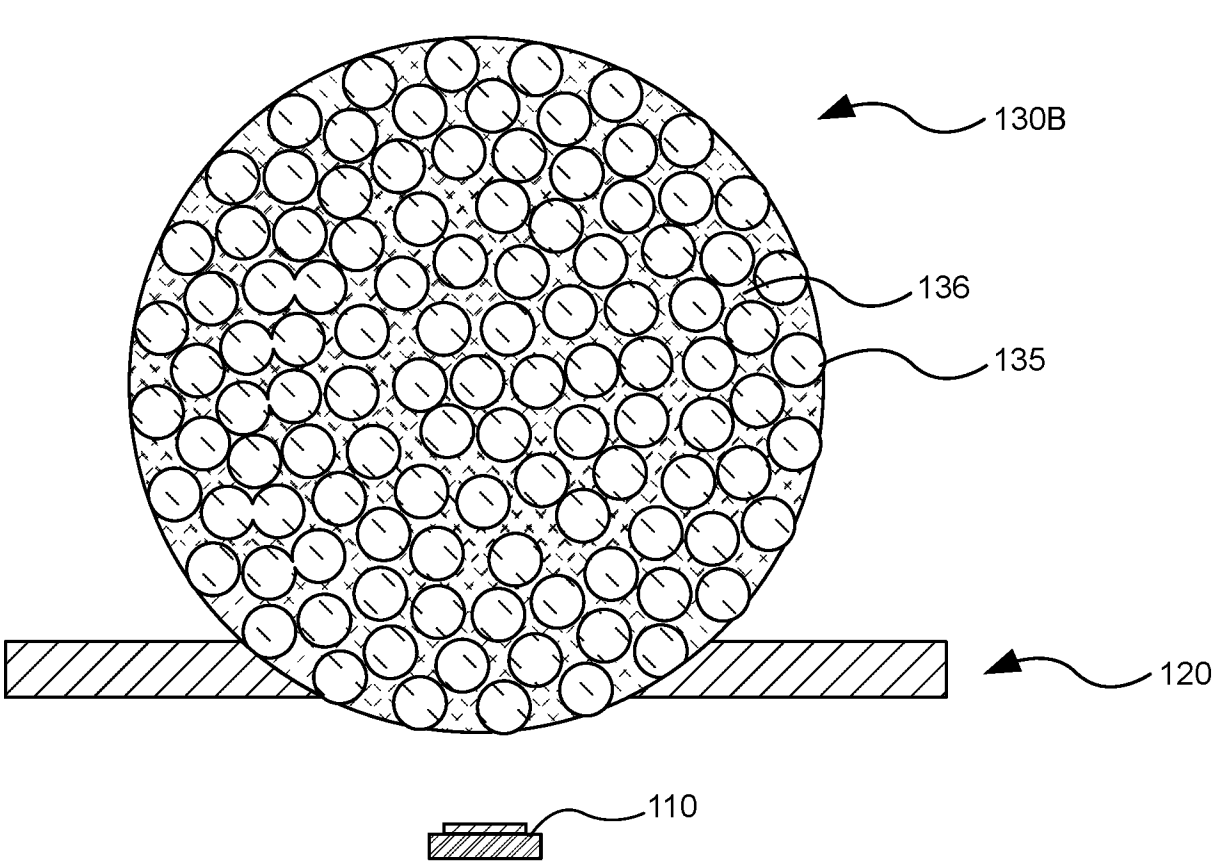
FIG. 7 is a side sectional view of an illuminating device of yet another embodiment of the present invention.

Referring to FIG. 7. In this embodiment, the illuminating device 100B has a light source 110, a lens holder 120, and a spherical modulator 130B. The spherical modulator 130B on the lens holder 120 also has a plurality of micro spheres 135, and the micro spheres 135 are distributed in concentric manner, while connected by the adhesive 136.

Figure 8:
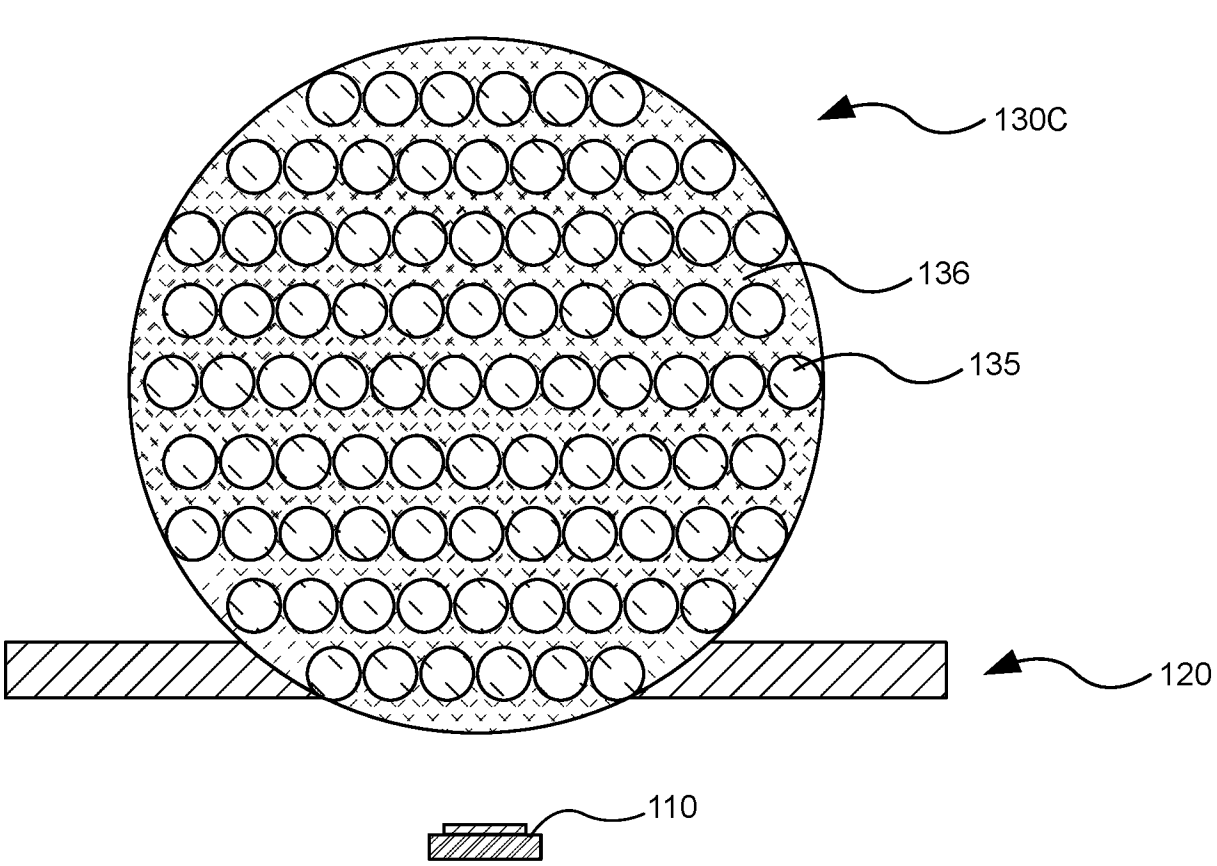
FIG. 8 is a side sectional view of an illuminating device of still another embodiment of the present invention.

Referring to FIG. 8. In this embodiment, the illuminating device 100C has a light source 110, a lens holder 120, and a spherical modulator 130C. The spherical modulator 130C on the lens holder 120 also has a plurality of micro spheres 135, and the micro spheres 135 are arranged in layers, while connected by the adhesive 136.

Figure 9:
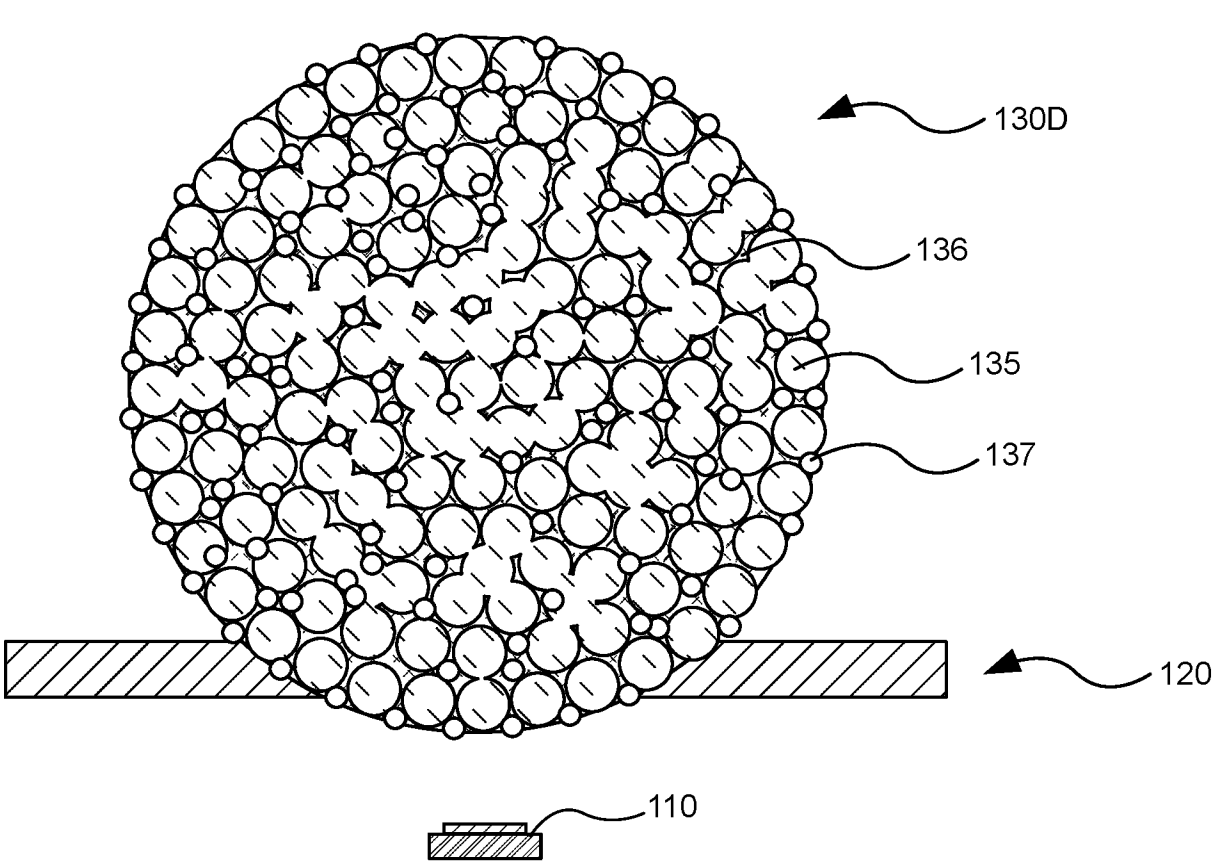
FIG. 9 is a side sectional view of an illuminating device of another embodiment of the present invention.

Referring to FIG. 9. In this embodiment, the illuminating device 100D has a light source 110, a lens holder 120, and a spherical modulator 130D. The spherical modulator 130D on the lens holder 120 has a plurality of micro spheres 137, and a ratio of a diameter of every micro sphere 137 to the diameter of every micro sphere 135 ranges from 0.1 to 0.9.

Moreover, the materials of the micro sphere 135 and the micro sphere 137 are different. In other words, the refractive index of the material of the micro sphere 135 and the refractive index of the material of the micro sphere 137 are different, and the micro spheres 135 and the micro spheres 137 are held together by the adhesive 136.

In this embodiment, the micro spheres 135 and the micro spheres 137 are randomly distributed in the spherical modulator 130D, while adhesive 136 occupies the rest of the area. Furthermore, a material of the adhesive 136 has a refractive index that is different form the refractive indices of the materials of the micro spheres 135 and 137. For example, the refractive index of the material of the adhesive 136 is close to 1, and, therefore, the micro spheres 135 and 137 in the spherical modulator 130D can provide proper light refraction.

Figure 10:
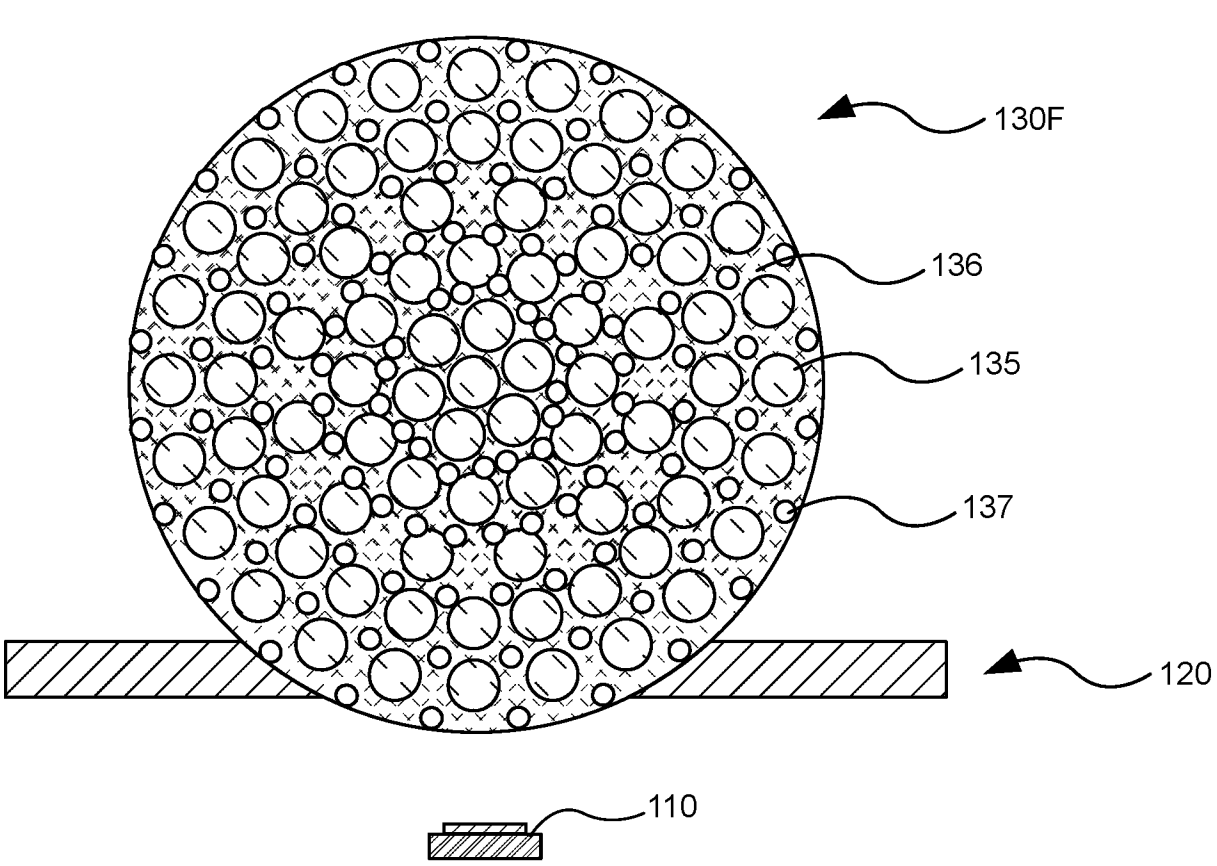
FIG. 10 is a side sectional view of an illuminating device of still another embodiment of the present invention.

Referring to FIG. 10. In this embodiment, the illuminating device 100E has a light source 110, a lens holder 120, and a spherical modulator 130E. The spherical modulator 130E on the lens holder 120 has a plurality of micro spheres 135 and a plurality of micro spheres 137 as well, and the micro spheres 135 and the micro spheres 137 are arranged in concentric manner, while the adhesive 136 connects all the micro spheres 135 and the micro spheres 137.

Figure 11:
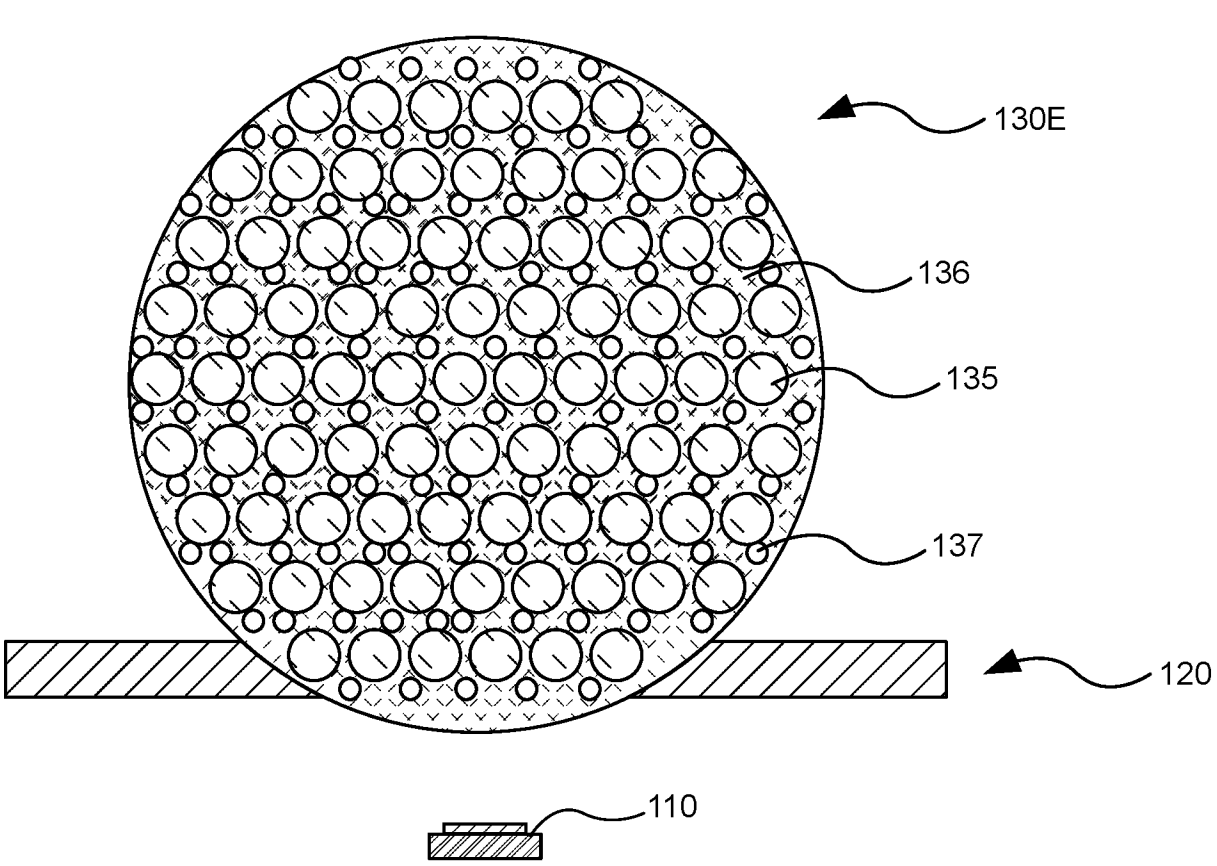
FIG. 11 is a side sectional view of an illuminating device of yet another embodiment of the present invention.

Referring to FIG. 11. In this embodiment, the illuminating device 100F has a light source 110, a lens holder 120, and a spherical modulator 130F. The spherical modulator 130F on the lens holder 120 has a plurality of micro spheres 135 and a plurality of micro spheres 137 as well, and the micro spheres 135 and the micro spheres 137 are arranged in layers, while the adhesive 136 connects all the micro spheres 135 and the micro spheres 137.

In the various embodiments of the present invention, the light from the light source 110 can be converged by the micro spheres 135 in the spherical modulator. In some other embodiments of the present invention, the light from the light source 110 can be converged by the micro spheres 135 and the micro spheres 137 in the spherical modulator, so as to provide a converged or parallel light with high efficiency and quality.

It should be apparent to those skilled in the art that many modifications besides those already described are possible without departing from the inventive concepts herein. The inventive subject matter, therefore, is not to be restricted except in the spirit of the invention. Moreover, in interpreting the invention, all terms should be interpreted in the broadest possible manner consistent with the context. In particular, the terms "includes", and "comprising" should be interpreted as "including", "comprises" referring to elements, components, or steps in a non-exclusive manner, indicating that the referenced elements, components, or steps may be present, or utilized, or combined with other elements, components, or steps that are not expressly referenced.

What is claimed is:

1. An illuminating device comprising:
a light source;
a lens holder, having a concave part and a blocking part surrounding the concave part, wherein the concave part has an aperture on its bottom; and
a spherical modulator, containing one or more materials having refractive indexes ranging from 1.3 to 2.7
wherein the lens holder is located between the light source and the spherical modulator, and the spherical modulator is disposed on the concave part of the lens holder and covers the aperture, and the light source provides light in a direction towards the aperture, and the light source and the aperture are aligned to an optical axis of the spherical modulator.

2. The illuminating device of claim 1, wherein the distance between the center of the spherical modulator and the light source is no more than a focal length of the spherical modulator.

3. The illuminating device of claim 1, wherein the blocking part forms a plate-like rim around the spherical modulator, and the lens holder is opaque or reflective, and a ratio of a diameter of the spherical modulator to a diameter of the lens holder ranges from 1 to 100.

4. The illuminating device of claim 3, wherein the shape of the rim is polygon or circle.

5. The illuminating device of claim 1, wherein the concave part forms a plate-like lip around the aperture, and the curvatures of the lip and an outer surface of the spherical modulator are the same.

6. The illuminating device of claim 1, wherein a material of the lens holder includes one of semiconducting materials and polymer-based materials.

7. The illuminating device of claim 1, wherein the spherical modulator has a sphere, and the sphere has a diameter ranging from 5 um to 500 um.

8. The illuminating device of claim 1, wherein the spherical modulator has a plurality of first micro spheres, and a diameter of every first micro sphere is at least 10 times smaller than a wavelength of the light from the light source.

9. The illuminating device of claim 8, wherein the spherical modulator has a plurality of second micro spheres, and a ratio of a diameter of every second micro sphere to the diameter of every first micro sphere ranges from 0.1 to 0.9.

10. The illuminating device of claim 9, wherein a refractive index of a material of the first micro sphere and a refractive index of a material of the second micro sphere are different.

11. The illuminating device of claim 8, wherein a material of the first micro sphere is one of glass and polymers.

* * * * *